US007834870B2

(12) United States Patent
Jeong

(10) Patent No.: US 7,834,870 B2
(45) Date of Patent: Nov. 16, 2010

(54) PLASMA DISPLAY DEVICE, POWER DEVICE THEREOF, AND DRIVING METHOD THEREOF

(75) Inventor: Jae-Seok Jeong, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 1392 days.

(21) Appl. No.: 11/257,114

(22) Filed: Oct. 25, 2005

(65) Prior Publication Data

US 2006/0232506 A1 Oct. 19, 2006

(30) Foreign Application Priority Data

Apr. 14, 2005 (KR) ..... 10-2005-0030992

(51) Int. Cl.
*G09G 5/00* (2006.01)

(52) U.S. Cl. ..... 345/211; 345/204; 345/60

(58) Field of Classification Search ..... 345/211, 345/204, 60

See application file for complete search history.

(56) References Cited

U.S. PATENT DOCUMENTS 5,745,086 A 4/1998 Weber
2003/0001802 A1* 1/2003 Ide et al. ..... 345/60
2004/0021656 A1* 2/2004 Kang et al. ..... 345/204
2004/0027316 A1 2/2004 Kang

FOREIGN PATENT DOCUMENTS

| | | |
|---|---|---|
| CN | 1448904 | 10/2003 |
| CN | 1495691 A | 5/2004 |
| CN | 1581268 | 2/2005 |
| JP | 04-340363 | 11/1992 |
| JP | 08-080037 | 3/1996 |
| JP | 2000-163011 | 6/2000 |
| JP | 2003-015593 | 1/2003 |
| JP | 2003-140601 | 5/2003 |
| JP | 2004-020906 | 1/2004 |
| WO | 2004-023634 | 3/2004 |

* cited by examiner

*Primary Examiner*—Amr Awad
*Assistant Examiner*—Leonid Shapiro
(74) *Attorney, Agent, or Firm*—H.C. Park & Associates, PLC

(57) ABSTRACT

A power supply for a plasma display device controls an output voltage by using a voltage divided by first resistors coupled to an output terminal, and outputs the output voltage as a driving voltage for driving a PDP. The output voltage is changed by varying a resistance of at least one first resistor from among the first resistors according to a temperature of the PDP.

6 Claims, 3 Drawing Sheets

PLASMA DISPLAY DEVICE, POWER DEVICE THEREOF, AND DRIVING METHOD THEREOF

CROSS-REFERENCE TO RELATED APPLICATION

This application claims priority to and the benefit of Korean Patent Application No. 10-2005-0030992, filed in the Korean Intellectual Property Office on Apr. 14, 2005, which is hereby incorporated by reference for all purposes as if fully set forth herein.

BACKGROUND OF THE INVENTION

1. Field of the Invention

The present invention relates to a plasma display device and a power supply thereof.

2. Discussion of the Background

Generally, a plasma display device includes a plasma display panel (PDP) that displays characters or images by using plasma generated by gas discharge. Depending on its size, the PDP may include more than several million pixels (discharge cells) arranged in a matrix pattern.

A method for driving a PDP may include dividing a frame into a plurality of weighted subfields, and each subfield may have a reset period, an address period, and a sustain period.

The plasma display device has a power supply that supplies a high voltage to a driving circuit to drive electrodes in the reset period, the address period, and the sustain period, and supplies a low voltage to an image processor, a fan, an audio unit, and a control circuit.

A conventional power supply applies the same driving voltage to components to drive the PDP irrespective of temperature. However, a PDP's discharge voltage and discharge characteristics vary depending on temperature. That is, the discharge voltage decreases when the temperature increases, and the discharge voltage increases when the temperature decreases. In particular, an opposed discharge may be generated stronger between two electrodes at a high temperature than between two electrodes at a low temperature. Hence, the generated discharge is not constant when the power supply supplies the same driving voltage irrespective of PDP temperature.

The above information disclosed in this Background section is only to enhance understanding of the background of the invention and therefore, it may contain information that does not form the prior art that is already known in this country to a person of ordinary skill in the art.

SUMMARY OF THE INVENTION

The present invention provides a plasma display device and a power supply thereof that may automatically control a driving voltage of the plasma display device according to temperature.

Additional features of the invention will be set forth in the description which follows, and in part will be apparent from the description, or may be learned by practice of the invention.

The present invention discloses a power supply for supplying power to a display panel. The power supply includes a transformer, a first switch, a plurality of first resistors, a variable resistor controller, a feedback circuit, and a feedback controller. The transformer includes a primary coil coupled to an input power and a secondary coil coupled to an output terminal. The first switch is coupled to the primary coil of the transformer and determines a voltage output to the output terminal according to a duty ratio. The first resistors are coupled in series with each other and to the output terminal. The variable resistor controller determines resistance of at least one first resistor in response to a temperature. The feedback circuit determines a feedback voltage in response to a voltage divided by the first resistors, and the feedback controller determines the duty ratio of the first switch in response to the feedback voltage.

The present invention also discloses a plasma display device including a PDP, a driver, a temperature detector, and a power supply. The PDP includes a plurality of first electrodes and a plurality of second electrodes, and discharge cells are formed at points where the first electrodes and the second electrodes cross. The driver drives electrodes of the PDP, and the temperature detector detects a temperature. The power supply controls an output voltage of the power supply by using a voltage divided by a plurality of first resistors coupled to an output terminal of the power supply, outputs the output voltage as a driving voltage of the driver, and varies resistance of at least one first resistor according to the temperature detected by the temperature detector.

The present invention also discloses a method for driving a display panel including a plurality of first electrodes, a plurality of second electrodes arranged crossing the first electrodes, and a plurality of discharge cells corresponding to points where the first electrodes and the second electrodes cross. The method includes applying a voltage to a first electrode, detecting a temperature, and adjusting the voltage applied to the first electrode according to the detected temperature.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

Figure 1:
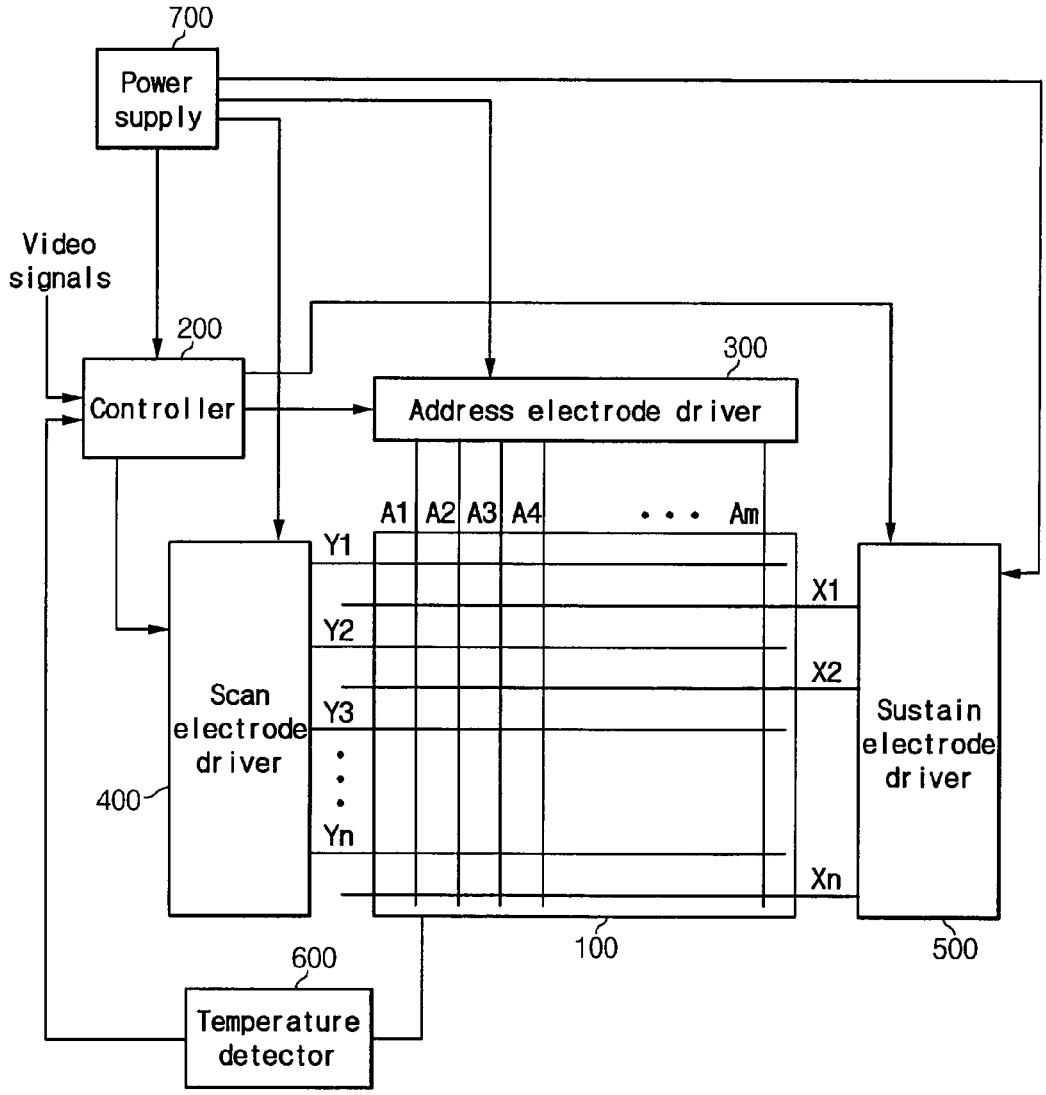
FIG. 1 shows a schematic diagram of a plasma display device according to an exemplary embodiment of the present invention.

Exemplary embodiments of the present invention will hereinafter be described in detail with reference to the accompanying drawings.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification. A coupled state of one element to another element includes a coupled state in which the two elements are directly coupled as well as a coupled state in which the two elements are coupled with another element provided between them.

A configuration of the plasma display device according to an exemplary embodiment of the present invention will be described in detail with reference to FIG. 1.

FIG. 1 shows a plasma display device according to an exemplary embodiment of the present invention.

As FIG. 1 shows, the plasma display device may include a PDP 100, a controller 200, an address electrode driver 300, a scan electrode driver 400, a sustain electrode driver 500, a temperature detector 600, and a power supply 700.

The PDP 100 includes a plurality of address electrodes A1-Am arranged in the column direction, and a plurality of sustain electrodes X1-Xn and scan electrodes Y1-Yn arranged in pairs in the row direction. The sustain electrodes X1-Xn are formed corresponding to the scan electrodes Y1-Yn, and their terminals are coupled together in common. The PDP 100 includes a substrate (not shown) on which the sustain and scan electrodes X1-Xn and Y1-Yn are is arranged, a substrate (not shown) on which the address electrodes A1-Am are arranged, and a discharge space between the two substrates. The two substrates are arranged to face each other so that the scan electrodes Y1-Yn and the sustain electrodes X1-Xn are substantially orthogonal to the address electrodes A1-Am. In this case, portions of the discharge space at points where the address electrodes A1-Am cross the sustain and scan electrodes X1-Xn and Y1-Yn form discharge cells. The PDP 100 shows one embodiment, but any PDP that may be driven by the subsequent driving waveforms may be applied to the present invention.

The controller 200 receives a video signal and outputs an address driving control signal, a sustain electrode driving control signal, and a scan electrode driving control signal. The controller 200 divides a frame into a plurality of subfields, and each subfield may include a reset period, an address period, and a sustain period.

The controller 200 receives a signal from the temperature detector 600 that indicates the temperature of the PDP 100 or the air temperature in the vicinity of the PDP 100 detected by the temperature detector 600 and transmits a signal for modifying the voltage of Vnf (refer to FIG. 2) or the voltage of VscL (refer to FIG. 2), according to the temperature of the PDP 100 or the air temperature in the vicinity of the PDP, to the power supply 700. In detail, the controller 200 outputs a signal for reducing the voltage of Vnf (refer to FIG. 2) as the temperature of the PDP 100 or the air temperature in the vicinity of the PDP 100 increases, and outputs a signal for increasing the voltage of VscL (refer to FIG. 2) when the temperature of the PDP 100 or the air temperature in the vicinity of the PDP 100 increases. Similarly, the controller 200 outputs a signal for increasing the voltage of Vnf and/or outputs a signal for decreasing the voltage of VscL when the temperature of the PDP 100 or the air temperature in the vicinity of the PDP 100 decreases.

In this case, a controller for receiving the signal for indicating the temperature of the PDP 100 or the air temperature in the vicinity of the PDP 100 from the temperature detector 600 may be separately provided.

The address electrode driver 300 receives the address electrode driving control signal from the controller 200 and applies a display data signal to the respective address electrodes to select a discharge cell to be turned on.

The scan electrode driver 400 receives the scan electrode driving control signal from the controller 200 and applies a driving voltage to the scan electrodes.

The sustain electrode driver 500 receives the sustain electrode driving control signal from the controller 200 and applies a driving voltage to the sustain electrodes.

The temperature detector 600 detects the temperature of the PDP 100 or the air temperature in the vicinity of the PDP 100 and transmits a signal for indicating the detected temperature to the controller 200. The temperature detector 600 may be formed on a board on which the controller 200 is provided.

The power supply 700 supplies power for driving the plasma display device to the controller 200 and the address, scan, and sustain electrode drivers 300, 400, and 500. In this case, the power supply 700 varies the voltage for driving the plasma display device according to the signal transmitted by the controller 200 and supplies the varied voltage to an applicable driver.

Exemplary driving waveforms of the plasma display device will now be described with reference to FIG. 2. For ease of description, the driving waveforms applied to the scan electrode (Y electrode), the sustain electrode (X electrode), and the address electrode (A electrode) that form a single discharge cell will be described.

Figure 2:
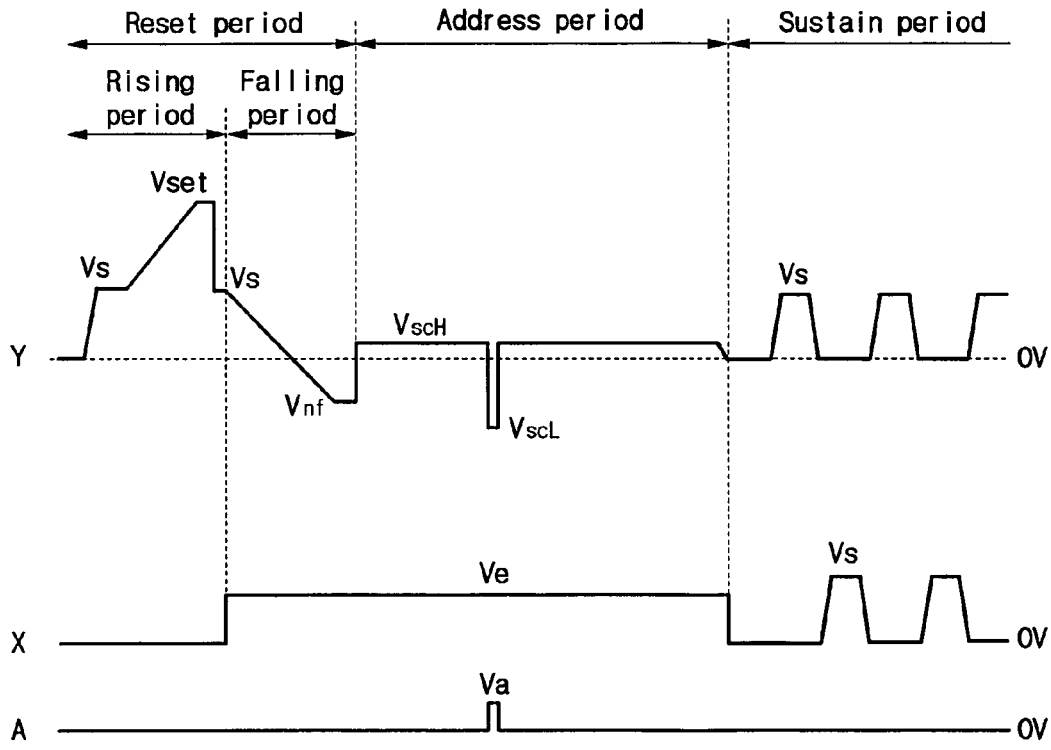
FIG. 2 shows driving waveforms of the plasma display device according to an exemplary embodiment of the present invention.

FIG. 2 shows driving waveforms of the plasma display device according to an exemplary embodiment of the present invention.

As FIG. 2 shows, in a rising period of the reset period, the voltage at the Y electrode gradually increases from the voltage of Vs to the voltage of Vset while maintaining the X electrode at 0V. The voltage at the Y electrode is shown in FIG. 2 to increase in a ramp pattern. While the voltage at the Y electrode increases, a weak discharge is respectively generated between the Y electrode and the X electrode and between the Y electrode and the A electrode, thereby forming negative wall charges at the Y electrode and positive wall charges at the X and A electrodes. When the voltage at the Y electrode is gradually varied as shown in FIG. 2, a weak discharge occurs in the discharge cell and wall charges are formed so that a sum of the externally applied voltage and the discharge cell's wall voltage may maintain the firing voltage, which is disclosed by U.S. Pat. No. 5,745,086. The voltage of Vset is set to be high enough to generate discharges in the cells since the cells are to be reset in the reset period. Also, the voltage of Vs is a higher voltage of the voltages applied to the Y electrode in the sustain period, and is lower than the firing voltage between the Y electrode and the X electrode.

In a falling period of the reset period, the voltage at the Y electrode gradually decreases from the voltage of Vs to the voltage of Vnf while maintaining the X electrode at the voltage of Ve. While the voltage at the Y electrode decreases, a weak discharge is respectively generated between the Y electrode and the X electrode and between the Y electrode and the A electrode, thereby substantially erasing the negative wall charges formed at the Y electrode and the positive wall charges formed at the X and A electrodes. In general, the voltage of (Vnf-Ve) is set to be about the firing voltage between the Y electrode and the X electrode. The wall voltage between the Y electrode and the X electrode then becomes almost 0V, and the discharge cells that are not address discharged in the address period are prevented from being erroneously sustain discharged in the sustain period.

In the address period, while maintaining the X electrode at the voltage of Ve, a scan pulse with the voltage of VscL and an address pulse with the voltage of Va are applied to the Y electrode and the A electrode, respectively, to select the discharge cell to be turned on. The Y electrode that is not selected is biased with the voltage of VscH, which is higher than the voltage of VscL, and a reference voltage is applied to the A electrode of a discharge cell that will not be turned on. An address discharge occurs in the discharge cell formed by the A electrode to which the voltage of Va is applied and the Y electrode to which the voltage of VscL is applied. In order to perform the above-noted operation in the address period, the scan electrode driver 400 selects a Y electrode to which the scan pulse with the voltage of VscL will be applied from among the Y electrodes Y1-Yn, and the address electrode driver 300 selects an A electrode to which the address pulse with the voltage of Va will be applied from among the A electrodes A1-Am.

In the sustain period, a sustain discharge pulse with the voltage of Vs is alternately applied to the Y electrode and the X electrode. A discharge occurs between the Y electrode and the X electrode of a selected discharge cell due to the wall voltage formed between the Y electrode and the X electrode during the address discharge in the address period and the voltage of Vs. A process of applying the sustain discharge pulse to the Y electrode and to the X electrode is repeated a number of times corresponding to the weight of the corresponding subfield.

However, a discharge may erroneously occur in an unselected discharge cell in the case of a high temperature, and a weak discharge may occur in a selected cell in the case of a low temperature since temperature influences the opposed discharge between the Y electrode and the A electrode in the address period. Therefore, erroneous discharges may be prevented when a large amount of wall charges are erased by decreasing the voltage of Vnf in the case of high temperature, and the weak discharge may be prevented when a small amount of wall charges are erased by increasing the voltage of Vnf in the case of low temperature. Similarly, erroneous discharges may be prevented when a discharge voltage is decreased by increasing the voltage of VscL in the case of high temperature, and the weak discharge may be prevented when the discharge voltage is increased by decreasing the voltage of VscL in the case of low temperature. Therefore, according to exemplary embodiments of the present invention, the power supply 700 may change the voltage of Vnf and/or VscL according to the temperature of the PDP 100 or the air temperature in the vicinity of the PDP 100 and output the changed voltage to the scan electrode driver 400.

Figure 3:
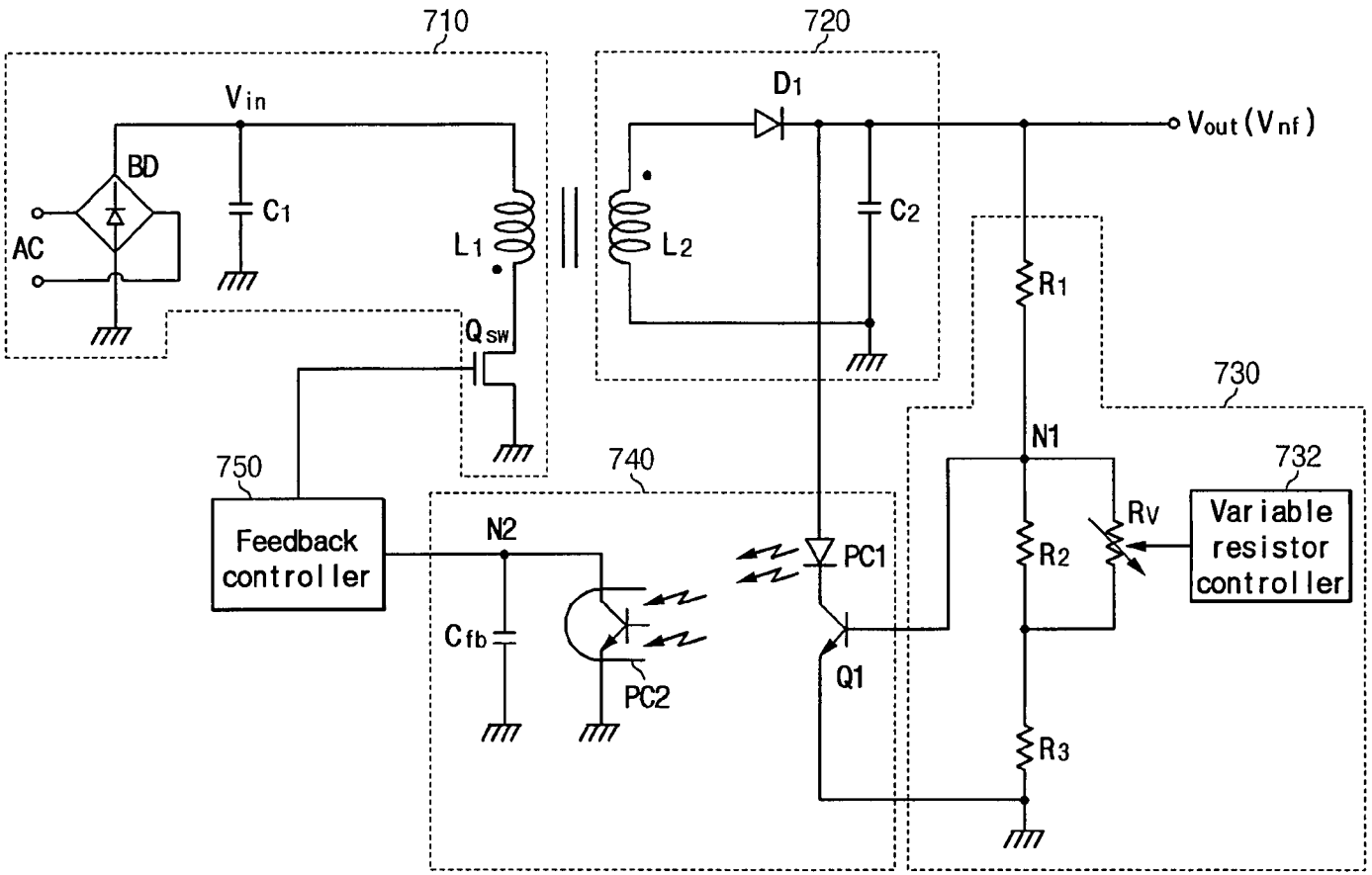
FIG. 3 shows a schematic diagram of a power supply of the plasma display device according to an exemplary embodiment of the present invention.

FIG. 3 shows a schematic diagram of a power supply of the plasma display device according to an exemplary embodiment of the present invention.

As FIG. 3 shows, the power supply 700 of the plasma display device may include a voltage supply 710, a voltage output unit 720, a voltage divider 730, a feedback circuit 740, and a feedback controller 750. The power supply 700 changes a driving voltage of the PDP 100 according to the temperature of the PDP 100 or the air temperature in the vicinity of the PDP 100.

The voltage supply 710 includes a bridge diode BD, a capacitor C1, a primary coil L1 of a transformer, and a transistor Qsw. The transistor Qsw is shown in FIG. 3 to be an NMOS transistor, however, other switches may be used. The primary coil L1 of the transformer and the transistor Qsw are coupled in series with each other between an output terminal of the bridge diode BD and ground, and a gate of the transistor Qsw is coupled to the feedback controller 750. A first terminal of the capacitor C1 is coupled to the bridge diode BD and the primary coil L1 of the transformer, and a second terminal of the capacitor C1 is grounded. Here, the bridge diode BD rectifies an alternating current (AC) voltage into a direct current (DC) voltage. The voltage supply 710 transmits the current determined by a duty ratio of the DC voltage Vin and the transistor Qsw to the voltage output unit 720 through the transformer L1, L2.

The voltage output unit 720 includes a secondary coil L2 of the transformer, a diode D1, and a capacitor C2. An anode of the diode D1 is coupled to a first terminal of the secondary coil L2 of the transformer, and a cathode of the diode D1 is coupled to the output voltage Vout. A first terminal of the capacitor C2 is coupled between the cathode of the diode D1 and the output voltage Vout, and a second terminal of the capacitor C2 is coupled to a second terminal of the secondary coil L2 of the transformer and ground. The voltage output unit 720 charges the capacitor C2 with a predetermined voltage corresponding to the current transmitted by the voltage supply 710, and supplies the charged voltage to an applicable driver.

The voltage divider 730 includes a variable resistor controller 732, resistors R1, R2, and R3, and a variable resistor Rv. The resistors R1, R2, R3 are coupled in series with each other between the output voltage Vout and ground, the resistor R2 is coupled in parallel with the variable resistor Rv, and the voltage divided by the resistors R1, R2, R3 is accordingly transmitted to the feedback circuit 740. In this case, the variable resistor controller 732 changes the resistance of the variable resistor Rv according to the temperature of the PDP 100 or the air temperature in the vicinity of the PDP 100 detected by the temperature detector 600.

The feedback circuit 740 includes a transistor Q1, a photo diode PC1, a photo transistor PC2, and a capacitor Cfb. The transistor Q1 is shown in FIG. 3 to be an npn bipolar transistor, but other switches may be used. A base of the transistor Q1 is coupled to a node N1 of the resistors R1, R2, and an emitter of the transistor Q1 is coupled to the resistor R3 and ground. The photo diode PC1 is coupled between a node of the diode D1 and the capacitor C2 and a collector of the transistor Q1, and the photo transistor PC2 is arranged to face the photo diode PC1 so that the photo diode PC1 and the photo transistor PC2 may form a photo coupler. The capacitor Cfb is coupled between the feedback controller 750 and ground, and the photo transistor PC2 is coupled between a node N2 of the feedback controller 750 and the capacitor Cfb and ground. In this case, the feedback circuit 740 provides information on the output voltage Vout caused by the resistance changed according to the temperature of the PDP 100 or the air temperature in the vicinity of the PDP 100 to the feedback controller 750.

The feedback controller 750 is coupled between the first terminal of the capacitor Cfb and the gate of the transistor Qsw, detects the voltage at the node N1, and determines the duty ratio of the signal transmitted to the gate of the transistor Qsw. In this case, the current flowing between a drain and a source of the transistor Qsw changes by a voltage difference between the gate and the source of the transistor Qsw according to the voltage supplied to the gate of the transistor Qsw.

An operation of the above-described power supply will now be described.

In general, the voltage Vout output by the voltage output unit 720 is determined according to the time when the transistor Qsw is turned on/off at the primary coil L1 of the transformer. That is, the duty ratio of the signal transmitted to the gate of the transistor Qsw from the feedback controller 750 is determined, and the current flowing between the drain and the source of the transistor Qsw is determined by the determined duty ratio. The voltage corresponding to the determined current is transmitted to the voltage output unit 720. The voltage output unit 720 then outputs a voltage corresponding to the voltage transmitted by the primary coil L1 of the transformer to an applicable driver.

The voltage Vout output by the voltage output unit 720 is fed back again, and the feedback controller 750 uses the fed back value to control the duty ratio of the transistor Qsw. The variable resistor controller 732 of the voltage divider 730 varies the resistance of the resistor Rv according to the temperature detected by the temperature detector 600. When the resistance of the resistor Rv changes, the voltage at the node N1 changes, the voltage between the base and the emitter of the transistor Q1 changes, and the current flowing between the collector and the emitter of the transistor Q1 changes. The changed voltage is detected by the photo transistor PC2, the capacitor Cfb discharges, and the voltage at the node N2 changes.

The feedback controller 750 changes the duty ratio of a control signal that is output to the gate of the transistor Qsw when the feedback voltage changes as the resistance of the variable resistor Rv varies. Therefore, the duty ratio of the transistor Qsw changes, and the voltage output by the voltage output unit 720 changes.

As described, the power supply 700 changes the output voltage for driving the plasma display device and outputs the changed voltage to an applicable driver by changing the resistance of the variable resistor Rv according to the temperature of the PDP 100 or the air temperature in the vicinity of the PDP 100.

Additionally, when a digital potentiometer is used for the variable resistor, the variable resistor controller 732 controls bits of the digital potentiometer by using bit control signals, thereby changing the resistance. The variable resistor controller 732 may store bit control values of the digital potentiometer corresponding to the temperature, and transmits a bit control signal to the digital potentiometer in response to the signal transmitted by the temperature detector 600. Also, when a plurality of variable voltages are provided (e.g., when the voltages of Vnf and VscL are varied according to temperature), the variable resistor controller 732 may store bit control values corresponding to the temperatures for the respective voltages.

According to the embodiments described above, the voltage of VscL and/or the voltage of Vnf may be modified. However, it is also possible to change the voltage of Va according to the temperature of the PDP 100 or the air temperature in the vicinity of the PDP 100. That is, the controller 200 outputs a signal for reducing the voltage of Va (FIG. 2) as the temperature of the PDP 100 or the air temperature in the vicinity of the PDP 100 increases, or it outputs a signal for increasing the voltage of Va (FIG. 2) as the temperature of the PDP 100 or the air temperature in the vicinity of the PDP 100 decreases. Accordingly, as the temperature of the PDP 100 or the air temperature in the vicinity of the PDP 100 increases, reducing the voltage of Va generates the same efficiency as increasing the voltage of VscL.

As described above, a driving voltage of the plasma display device changes according to the temperature of the PDP or the air temperature in the vicinity of the PDP. That is, the plasma display device may be securely driven by applying an optimized driving voltage to the plasma display device according to the temperature.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display device, comprising:

a plasma display panel (PDP) including a plurality of first electrodes and a plurality of second electrodes, and in which discharge cells are formed corresponding to points where the first electrodes and the second electrodes cross;

a driver for driving electrodes of the PDP;

a temperature detector for detecting a temperature;

a power supply; and a controller, wherein the power supply controls an output voltage of the power supply by using a voltage divided by a plurality of first resistors coupled to an output terminal of the power supply, outputs the output voltage as a driving voltage of the driver, and varies resistance of at least one first resistor according to the temperature detected by the temperature detector, wherein the controller divides a frame into a plurality of subfields, a subfield including a reset period, an address period, and a sustain period, wherein the driver gradually decreases a voltage at a first electrode from a first voltage to a second voltage in the reset period, wherein the output voltage of the power supply comprises the second voltage, and wherein when the temperature of the PDP is at a first temperature, the power supply adjusts the second voltage to be lower than the second voltage when the temperature of the PDP is at a second temperature, the second temperature being lower than the first temperature, and wherein the power supply comprises:

a transformer including a primary coil coupled to an input power and a secondary coil coupled to an output terminal;

a first switch coupled to the primary coil and determining a voltage output to the output terminal according to a duty ratio;

a variable resistor controller for determining a resistance of at least one first resistor in response to the temperature of the PDP;

a feedback circuit for determining a feedback voltage in response to the voltage divided by the first resistors; and a feedback controller for determining the duty ratio of the first switch in response to the feedback voltage.

2. The plasma display device of claim 1, wherein the at least one first resistor comprises a digital potentiometer, and the variable resistor controller controls bits of the digital potentiometer by using a bit control signal to change the resistance of the at least one first resistor.

3. The plasma display device of claim 1, wherein the at least one first resistor comprises a first resistor coupled in parallel with a digital potentiometer, and the variable resistor controller controls bits of the digital potentiometer by using a bit control signal to change the resistance of the at least one first resistor.

4. A plasma display device, comprising:

a plasma display panel (PDP) including a plurality of first electrodes and a plurality of second electrodes, and in which discharge cells are formed corresponding to points where the first electrodes and the second electrodes cross;

a driver for driving electrodes of the PDP;

a temperature detector for detecting a temperature;

a power supply; and a controller, wherein the power supply controls an output voltage of the power supply by using a voltage divided by a plurality of first resistors coupled to an output terminal of the power supply, outputs the output voltage as a driving voltage of the driver, and varies resistance of at least one first resistor according to the temperature detected by the temperature detector, wherein the controller divides a frame into a plurality of subfields, a subfield including a reset period, an address period, and a sustain period, wherein the driver applies a first voltage to a first electrode of a discharge cell to be turned on in the address period, wherein the output voltage of the power supply comprises the first voltage, and wherein when the temperature of the PDP is at a first temperature, the power supply adjusts the first voltage to be higher than the first voltage when the temperature of the PDP is at a second temperature, the second temperature being lower than the first temperature, and wherein the power supply comprises:

a transformer including a primary coil coupled to an input power and a secondary coil coupled to an output terminal;

a first switch coupled to the primary coil and determining a voltage output to the output terminal according to a duty ratio;

a variable resistor controller for determining a resistance of at least one first resistor in response to the temperature of the PDP;

a feedback circuit for determining a feedback voltage in response to the voltage divided by the first resistors; and a feedback controller for determining the duty ratio of the first switch in response to the feedback voltage.

5. The plasma display device of claim 4, wherein the at least one first resistor comprises a digital potentiometer, and the variable resistor controller controls bits of the digital potentiometer by using a bit control signal to change the resistance of the at least one first resistor.

6. The plasma display device of claim 4, wherein the at least one first resistor comprises a first resistor coupled in parallel with a digital potentiometer, and the variable resistor controller controls bits of the digital potentiometer by using a bit control signal to change the resistance of the at least one first resistor.

* * * * *